US005611276A

United States Patent [19]

Haupenthal

[11] Patent Number: 5,611,276

[45] Date of Patent: Mar. 18, 1997

[54] SUCTION-TYPE GRIPPERS FOR A SHEET TRANSFER DRUM

[75] Inventor: Rudi Haupenthal, Epfenbach, Germany

[73] Assignee: Heidelberger Druckmaschinen AG, Heidelberg, Germany

[21] Appl. No.: 240,920

[22] Filed: May 10, 1994

[30] Foreign Application Priority Data

May 10, 1993 [DE] Germany ..... 43 15 511.1

[51] Int. Cl.[6] ..... B41F 13/24

[52] U.S. Cl. ..... 101/232; 101/410

[58] Field of Search ..... 101/232, 233, 101/230, 229, 231, 225, 410, 420

[56] References Cited

U.S. PATENT DOCUMENTS

| | | | |
|---|---|---|---|
| 4,688,784 | 8/1987 | Wirz | 271/195 |
| 4,723,488 | 2/1988 | Inouye et al. | 101/232 |
| 4,735,142 | 5/1988 | Haupenthal | 101/246 |
| 4,930,414 | 6/1990 | Wirz | 101/230 |
| 5,263,415 | 11/1993 | Pollich | 101/232 |

OTHER PUBLICATIONS

Friday, "Transfer Apparatus", Xerox Disclosure Journal, vol. 1, No. 7, Jul./1976, p. 67.

Burnard, "Flow Reduction on Gated Transports" Xerox Disclosure Journal, vol. 9, No. 2, Mar./Apr./84, p. 119.

*Primary Examiner*—Edgar S. Burr

*Assistant Examiner*—Anthony H. Nguyen

*Attorney, Agent, or Firm*—Herbert L. Lerner; Laurence A. Greenberg

[57] ABSTRACT

Suction-type grippers for a sheet-transfer drum includes a sheet-supporting element having a sheet-supporting surface formed with a plurality of suction-air openings disposed along a region thereof to be covered by at least one sheet edge, at least one flexible planar member disposed adjacent to said sheet-supporting element at a side thereof facing away from the sheet-supporting surface thereof, the flexible planar member having a member for sealing at least some of the suction-air openings.

1 Claim, 1 Drawing Sheet

7
9
5
10
13
16
3
2
11
12
1
III
III
8
4
6

10
1
13
14
16
15
12

4
8
10
5
1
2
16
9

SUCTION-TYPE GRIPPERS FOR A SHEET TRANSFER DRUM

SPECIFICATION

The invention relates to suction-type grippers for a sheet transfer drum which, more particularly, is applicable for use in sheet-fed rotary printing presses wherein sheet-transfer drums are provided for transporting sheets which are held in grippers on the sheet-transfer drums, at least some of the grippers being in the form of suction-type grippers.

It has become known heretofore to provide sheet-transfer drums with suction-type grippers having several suction elements arranged equidistantly spaced from one another in a row for holding a sheet at a sheet edge along a line on the outer cylindrical surface of the sheet-transfer drum. In this regard, reference can be made to published Japanese Patent Documents 4-161336, 4-153039 and 4-158041, and published German Patent Document 35 35 621 A1, for example.

A disadvantage of such a construction is that the holding force of the sheet or sheets is produced only at the discrete locations at which a respective suction element is located underneath the sheet. While the sheet is being held, there is a risk that the sheet, especially if it is a relatively thin sheet, will be deformed at the aforementioned locations, which can have a detrimental effect upon the printing quality. When printing on sheets with relatively small format widths, the suction air applied by the outerlying suction elements of the aforementioned line thereof is shut off so that only a few suction elements are used to hold a respective sheet, and so that a slight holding force can be applied. In different constructions of the prior art, it is possible to adjust the positions of the suction elements to suit a respective sheet format or size to be printed by moving the suction-type grippers in a direction towards the central plane of the sheet-transfer drum perpendicularly to the sheet-travel direction and, thereafter, fixing the suction-type grippers in place. Such constructions which include guides and holding means are quite expensive, requiring much material and considerable outlay in time and money, while presenting the disadvantage that an impermissible deformation of the sheet remains at the suction location.

The published European Patent Document 0 165 477 A1 describes a packing or dressing for a sheet-transfer drum, the packing being formed with openings or crevices to which suction air is applicable. In a modification of the foregoing construction, a storage drum is provided with a suction box disposed in the vicinity of a trailing sheet edge and being adjustable in sheet-travel direction, the suction box being packaged with the aforementioned packing for holding the sheet and being connected via a pipeline to a vacuum or negative-pressure generator. A disadvantage thereof is that no possibility is provided therein for adapting the suction surface holding the sheet to a smaller sheet format or size. When sheets of relatively small format width are being conveyed, air is sucked through the openings or crevices in the packing from the free ambient environment of the sheet, which is detrimental to maintaining a negative pressure underneath the sheet.

It is accordingly an object of the invention to provide a suction-type gripper or a sheet-transfer drum which is formed with a plurality of suction-air openings, which affords a large-areal support for a sheet to be held, and which has suction properties adjustable to the respective sheet format width.

With the foregoing and other objects in view, there are provided, in accordance with the invention, suction-type grippers for a sheet-transfer drum comprising a sheet-supporting element having a sheet-supporting surface formed with a plurality of suction-air openings disposed along a region thereof to be covered by at least one sheet edge, at least one flexible planar member disposed adjacent to the sheet-supporting element at a side thereof facing away from the sheet-supporting surface thereof, the flexible planar member having means for sealing at least some of the suction-air openings. The flexible planar member may be in the form of a tape, a belt or a strap.

The gist of the invention is thus that some of the suction-air openings of a suction-type gripper can be sealed along a sheet edge by means of at least one tape, belt, or strap. Assurance is thereby provided that large areas of a sheet which is to be held are in contact with the sheet-supporting element, thereby avoiding any deformation in marginal areas of the sheet. The tape, belt, or strap can seal those suction-air openings which lie outside or beyond a respective sheet format and consequently do not hold the sheet, thereby permitting an adjustment to a different sheet format. One or more of such suction grippers, depending upon the respective sheet and the respective sheet transfer drum, may be provided over the entire sheet width or in partial regions thereof. The aforementioned displacement may be remotely controlled by means of a conventional control unit of the printing press.

In accordance with a concomitant feature of the invention, the at least one flexible planar member comprises two toothed endless belts displaceable with respect to one another, respective toothed-belt pulleys revolvingly carrying the toothed endless belts to locations at which the sealing means underlie at least some of the suction-air openings so as to close the at least some of the suction-air openings, and a suction box disposed adjacent the toothed endless belts for guiding the belts laterally and with respect to the sheet-supporting element, the suction box being formed with a longitudinal slot underlying the region of the sheet-supporting surface, and means for connecting the suction box to a suction-air source.

Thus, in accordance with a desirable modification of this construction, two toothed belts are provided which can be displaced with respect to one another, each thereof, beyond or outside the sheet-supporting region, being looped around and running over a driving toothed-belt pulley. By means of a suction box, the toothed belts may be guided laterally and with respect to the sheet-supporting element, the toothed belts forming means for sealing or closing the suction-air openings formed in the sheet-supporting element. In the guide surface extending between the toothed belt and the suction box, said suction box is formed with a longitudinal extending over the sheet-supporting region. The suction box is connected to a suction-air source.

Other features which are considered as characteristic for the invention are set forth in the appended claims.

Although the invention is illustrated and described herein as embodied in a suction-type gripper for a sheet-transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
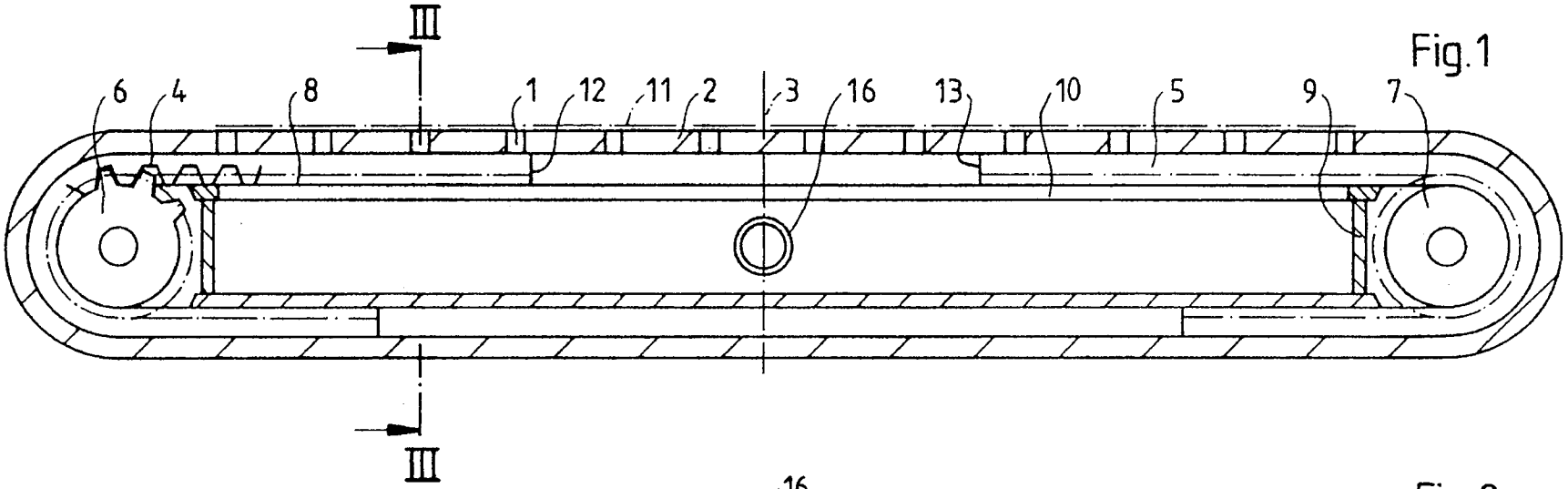
FIG. 1 is a longitudinal sectional view of a suction-type gripper according to the invention.
Figure 2:
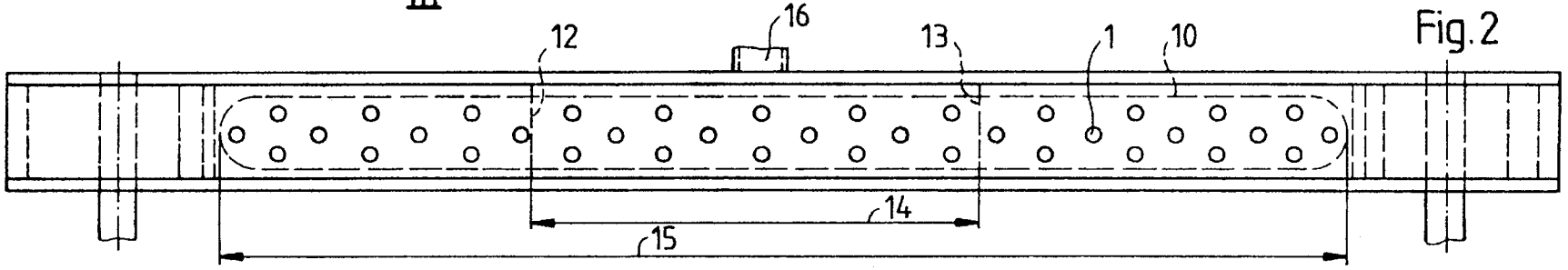
FIG. 2 is a top plan view of FIG. 1.
Figure 3:
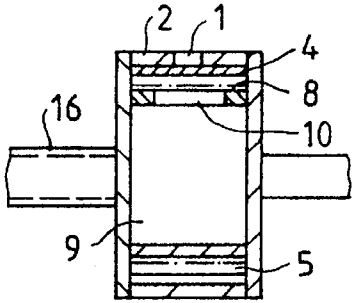
FIG. 3 is a cross-sectional view of FIG. 1 taken along the line III—III in the direction of the arrows.

Referring now to the figures of the drawing, there is shown therein a suction-type gripper provided on a sheet-transfer drum, a sheet-supporting element 2 being provided in an outer cylindrical surface of the sheet-transfer drum and being formed with suction-air openings 1. Below the sheet-supporting element 2, two toothed belts 4 and 5 slide in the manner of sealing or locking members for the suction-air openings 1, respectively, symmetrically to a central plane 3 of the sheet-transfer drum, the toothed belts 4 and 5 being wound around and meshing with respective toothed-belt pulleys 6 and 7. On the side thereof facing away from the suction-air openings 1, the toothed belts 4 and 5 slide on a guide surface 8 of a suction box 9. The guide surface 8 is formed with a longitudinal slot 10 extending parallel to a line 11 extending along the outer cylindrical surface of the sheet-transfer drum. The toothed-belt pulleys 6 and 7 can be driven independently of one another in different directions of rotation. During rotation of one toothed-belt pulley 6 or 7, the respective end 12, 13 of the respective toothed belt 4, 5 is displaced in a direction towards the central plane 3 so that, in a region 15 for a maximum format width to a region 14 for a minimum format width, some of the suction-air openings 1 may be closed or sealed. The sheet is held on the sheet-supporting element 2 only in the region 14 not covered by the toothed belts 4 and 5 because only the suction-air openings 1 of this region 14 are connected to a non-illustrated suction-air source via the longitudinal slot 10, the hollow space or cavity within the suction box 9 and a suction-air union or connection 16 to the suction box 9.

I claim:

1. In combination with a sheet transfer drum of a rotary printing machine at which sheets with a sheet width are transferred, a suction device comprising:

a suction-air box;

a sheet-supporting surface disposed above said suction box, said sheet-supporting surface having a multiplicity of suction-air openings formed therein disposed along a region thereof to be covered by at least one sheet edge and communicating with said suction-air box;

two toothed-belt pulleys disposed laterally of said sheet-supporting surface;

two toothed-belt sections each wound around and meshing with a respective one of said pulleys and being displaceable relative to one another by selectively rotating a respective one of said two toothed-belt pulleys; and a guide surface supporting said toothed-belt sections above said suction box, said guide surface having a longitudinal slot formed therein across an entire sheet width;

said toothed-belt sections forming means for selectively closing a portion of said longitudinal slot and sealing selected ones of said suction-air openings.

* * * * *